United States Patent [19]

Frahm et al.

[11] Patent Number: 4,693,400

[45] Date of Patent: Sep. 15, 1987

[54] EXTENDABLE-NESTABLE DISPENSING APPARATUS

[76] Inventors: Carl E. Frahm, 1428 Oak Meadow Rd.; B. Joseph Rokus, 1420 Oak Meadow Rd., both of Arcadia, Calif. 91006

[21] Appl. No.: 769,570

[22] Filed: Aug. 26, 1985

[51] Int. Cl.[4] ..... B67D 3/00; B65D 47/30

[52] U.S. Cl. ..... 222/518; 222/529; 222/530; 222/153; 222/538

[58] Field of Search ..... 222/529, 530, 518, 543, 222/527, 215, 538, 539, 537, 526, 153, 511, 540; 251/342

[56] References Cited

U.S. PATENT DOCUMENTS

| | | | |
|---|---|---|---|
| 549,678 | 11/1895 | Miller | 222/518 UX |
| 2,900,113 | 8/1959 | McKone | 222/215 |
| 3,204,827 | 9/1965 | Krautkrämer | 222/530 X |
| 3,502,246 | 3/1970 | Kelbch | 222/529 X |
| 3,584,834 | 6/1971 | Reid | 222/518 X |
| 3,856,187 | 12/1974 | Chlystun | 222/541 X |
| 4,073,413 | 2/1978 | Tabler et al. | 222/543 X |
| 4,327,842 | 5/1982 | Walter | 222/543 X |
| 4,452,425 | 6/1984 | Lucking | 222/518 X |
| 4,529,108 | 7/1985 | Chlystun | 222/530 X |
| 4,534,542 | 8/1985 | Russo | 251/342 |

FOREIGN PATENT DOCUMENTS

80/02546 11/1980 PCT Int'l Appl. ..... 222/529

*Primary Examiner*—Joseph J. Rolla
*Assistant Examiner*—Nils E. Pedersen
*Attorney, Agent, or Firm*—Lyon & Lyon

[57] ABSTRACT

The invention comprises a nestable-extendable apparatus for dispensing fluids from a container. The dispensing apparatus is nestable—i.e., capable of being collapsed or inverted into the container when not in use and extended or telescoped therefrom when needed to dispense fluid. The apparatus includes a selectively operable dispensing valve at the outboard end of a flexible, extendable, nestable member preferably of generally circular cross section and generally conical longitudinal section. The dispensing valve can be "nested", or collapsed into the container by inverting the membrane within itself into the container, and can be "telescoped" or extended by manually pulling the valve and membrane into the extended position by means of a pull-out ring. The dispensing valve can be collapsed into an opening in the container wall. The dispensing valve of the preferred embodiment may be opened by pressing a button with the thumb. The valve is preferably biased to close automatically when thumb pressure is released.

4 Claims, 5 Drawing Figures

EXTENDABLE-NESTABLE DISPENSING APPARATUS

BACKGROUND OF THE INVENTION

The field of the present invention is valves for dispensing fluids from containers, and in particular extendable-nestable devices of this type. An extendable-nestable device is one which telescopes or extends out (extendable) from the fluid container during use but which can be collapsed or inverted back (nestable) into itself when not in use, so that the dispensing deviec does not protrude substantially beyond the external dimensions of the container itself when nested. A principal advantage of the nestability feature is that it permits more compact, more stable and less accident prone arrangement of containers during storage and shipment, and yet has the desired dispensing capability when in use.

Nestable pouring spouts are known in the art. For example, Dwindell, U.S. Pat. No. 4,442,949, discloses a nestable pouring spout which is sealed before use by a tear-out diaphragm and is recloseable after use by means of a threaded cap. Borah, U.S. Pat. No. 2,804,242, discloses a similar nestable pouring spout, also reclosable by means of a threaded cap. Newcomb, U.S. Pat. No. 3,401,851, discloses a flexible tubular spout which can be snipped off at any desired length to allow liquid, such as milk, to be poured through it. Prior to use, the spout is folded back upon iself so that it does not protrude beyond the boundary of the container to which it is attached. Black, U.S. Pat. No. 4,256,154, discloses a bottle spout with a flexible funnel that can be inverted into the neck of the spout when not in use. The neck can be closed by means of a screw-on cap. Babiol, U.S. Pat. No. 4,311,259, appears to disclose a rigid tubular pouring spout which fits slidably within an annular base that is bonded to the container wall. The spout, reclosable by a threaded cap, can be nested into the container simply by sliding it.

SUMMARY OF THE INVENTION

The present invention is directed to an extendable-nestable assembly for dispensing fluids from a container. The assembly is preferably reclosable by means of a manually-operated dispensing valve. The assembly attaches by means of an annular attachment means to the wall of the container from which the fluid is to be dispensed. The annular attachment means may be permanently bonded to the container wall or sealed thereto in any fluid-impermeable manner, as, for example, in the manner of a snap-on or screw-on cap.

The assembly is desirably afforded an extendable, nestable capability which in the preferred embodiment includes a flexible, fluid-impermeable membrane, generally circular in cross-section and conical in longitudinal section, which connects the annular attachment means to the dispensing valve. The flexible membrane cone may be extended from the container or inverted back through the annular attachment means to "nest" within a cavity defined by the attachment means so that no part of the assembly protrudes outwardly from the container beyond the plane of the face of the attachment means.

In the illustrated preferred embodiment, the dispensing valve desirably includes a foldable pulling tab, desirably in the form of a pull-out ring, which is conveniently usable as a handle to pull the valve from its nested position into its extended position so that it is accessible for use. The pull-out ring is restrained by a locking tab when the device is in its collapsed or "nested" position, preferably so that the ring does not protrude outwardly from the container beyond the plane of the face of the annular attachment means. The dispensing valve of the preferred embodiment is desirably a manually operated valve assembly that remains open as long as thumb pressure is applied but which is biased to reclose automatically when thumb pressure is withdrawn. The dispensing valve is desirably of a compact design so that the annular attachment means (or other cavity-defining means) need not be large in order to accomodate the valve in its nested position.

It is thus an object of the invention to provide a novel, compact fluid dispensing apparatus of the extendable, collapsible type. A further object of the invention is to provide an extendable dispensing apparatus which has a dispensing valve for accurately and conveniently controlling dispensing flow. These objects and further objects, features and advantages of the invention will become more apparent as the following detailed description of the preferred embodiment thereof proceeds with continued reference to the appended drawings forming a part hereof wherein:

DETAILED DESCRIPTION OF THE PREFERRED EMBODIMENT

Figure 1:
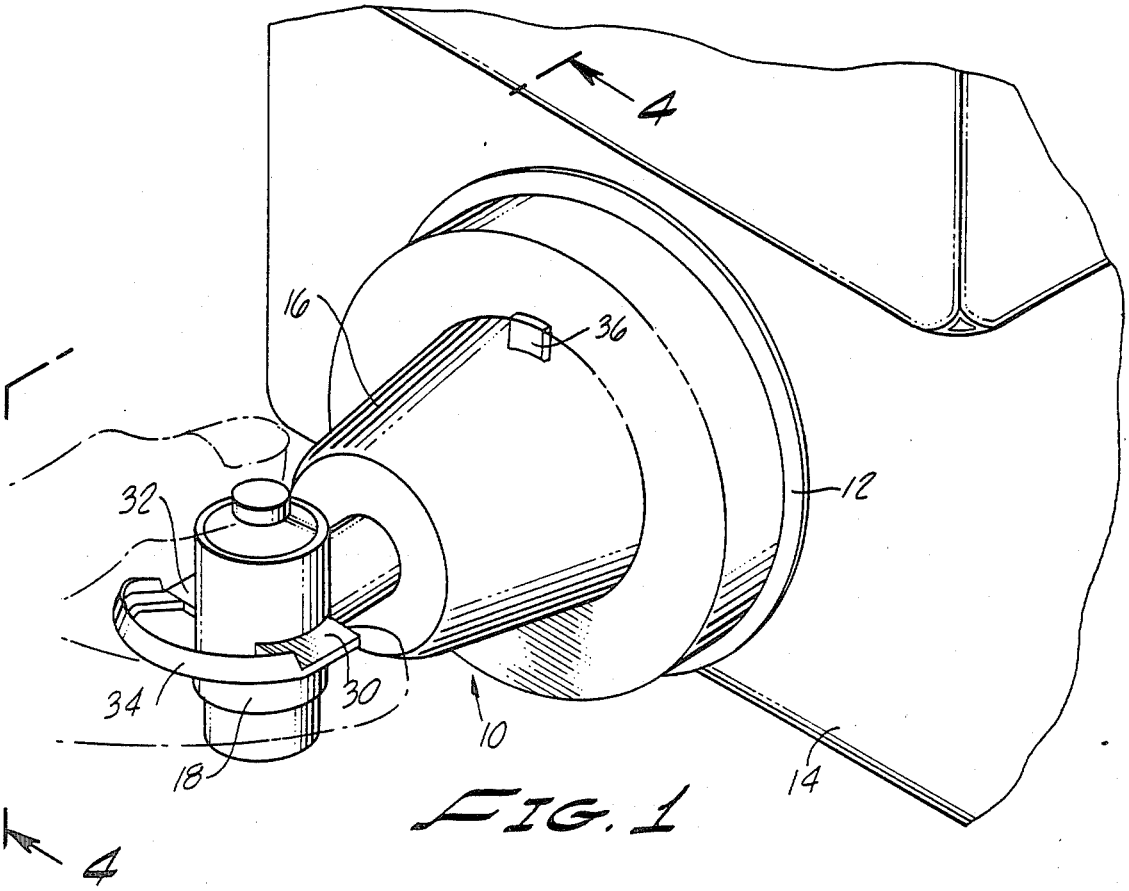
FIG. 1 is a perspective view of an extendable-nestable dispensing apparatus in accordance with the preferred embodiment of the invention in its extended, or telescoped, position ready for use, showing a thumb-operated dispensing valve, an annular attachment means of the snap-on cap type, and a portion of the wall of the container to which the dispensing apparatus is attached.

Turning now to the drawings, FIG. 1 illustrates an extendable-nestable dispensing apparatus indicated generally as 10 in its extended position, ready for dispensing. An attachment means 12 at the base of the dispensing apparatus 10 attaches to the wall of the fluid container 14 in the manner of a snap-on cap. (A screw-on cap could be used with equal advantage, and for some applications a permanently bonded attachment might be preferred. All fluid-impermeable modes of attachment are within the scope of the invention.) A flexible extendable-nestable member 16, which in the preferred embodiment is generally circular in cross section and generally tapered (i.e., conical) in longitudinal section, made from a flexible fluid-impermeable material, is secured at its base to the attachment means 12.

Figure 4:
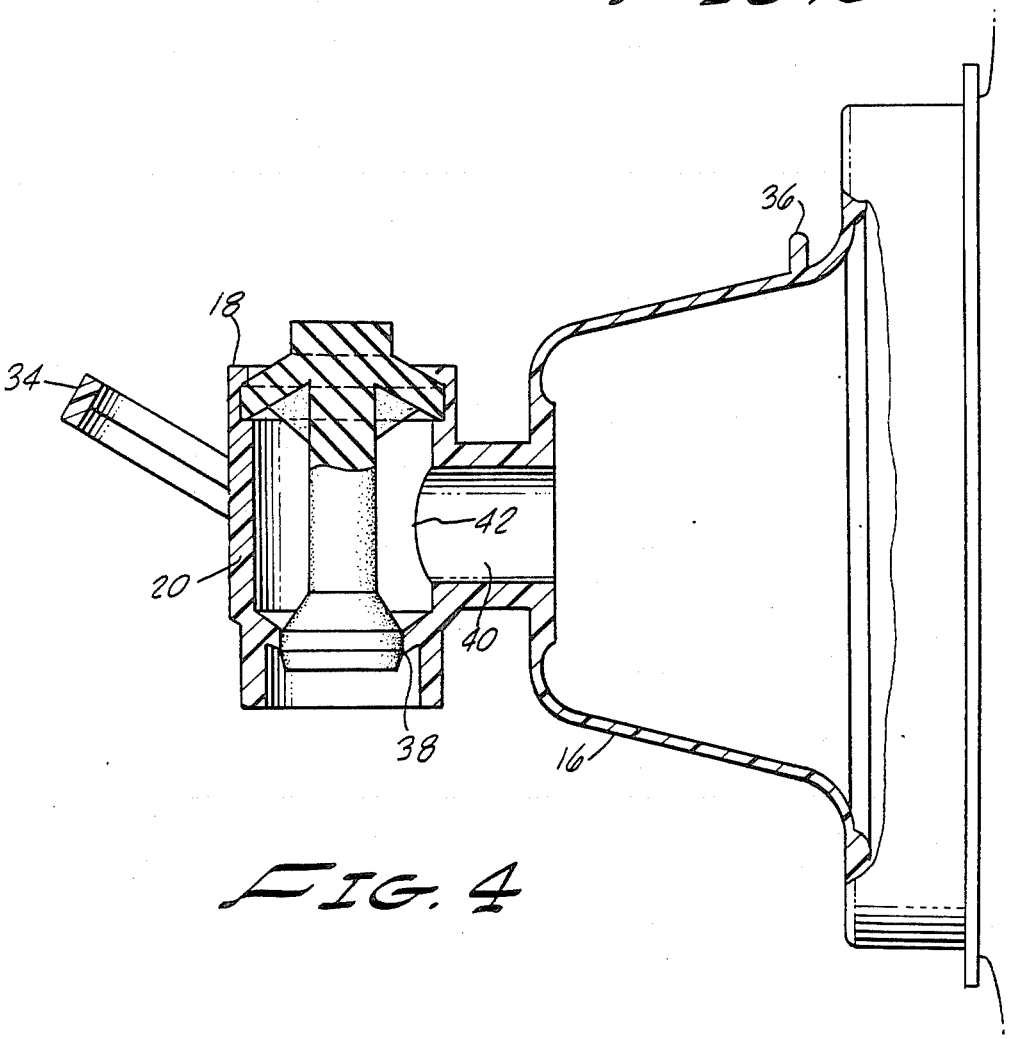
FIG. 4 is a side elevation, partially in section, taken about line 4—4 of FIG. 1 with the dispensing valve in its closed position.

A selectively operable dispensing valve 18 is secured to the outboard end of the flexible member 16 in fluid communication with the container 14 (see FIG. 4). In the preferred embodiment of the invention, body 20 of the dispensing valve 18 (FIG. 4) desirably is a single molded piece of plastic. It should be appreciated that many durable materials impermeable to the fluid being handled and not chemically or physically reactive with it might be advantageously employed for this purpose. For example, in an experimental model of the apparatus 10, satisfactory performance was obtained by making the valve body 20 and all other portions of the apparatus except the valve stem 22 from a clear plastic which is marketed under the DuPont trademark "Elvax".

The valve body 20 houses a valve stem 22 which passes longitudinally therethrough. The valve stem 22 comprises a pressure button 24 and a flexible diaphragm 26 at its first (proximal) end and a bevelled plug 28 at its second (distal) end. Supports 30 and 32 (FIG. 1) are attached to the exterior surface of the valve body 20. A user's fingers can conveniently be braced under the finger supports 30 and 32 while the user's thumb depresses the pressure button 24 to open the valve and dispense fluid from the container. A flexible, foldable pull-out tab, desirably in the form of a ring 34, is attached to the finger supports. The ring 34 can conveniently be used as a handle to pull the dispensing valve 18 out of its nesting position (FIG. 2) into its extended position (FIG. 1) as desired.

Figure 2:
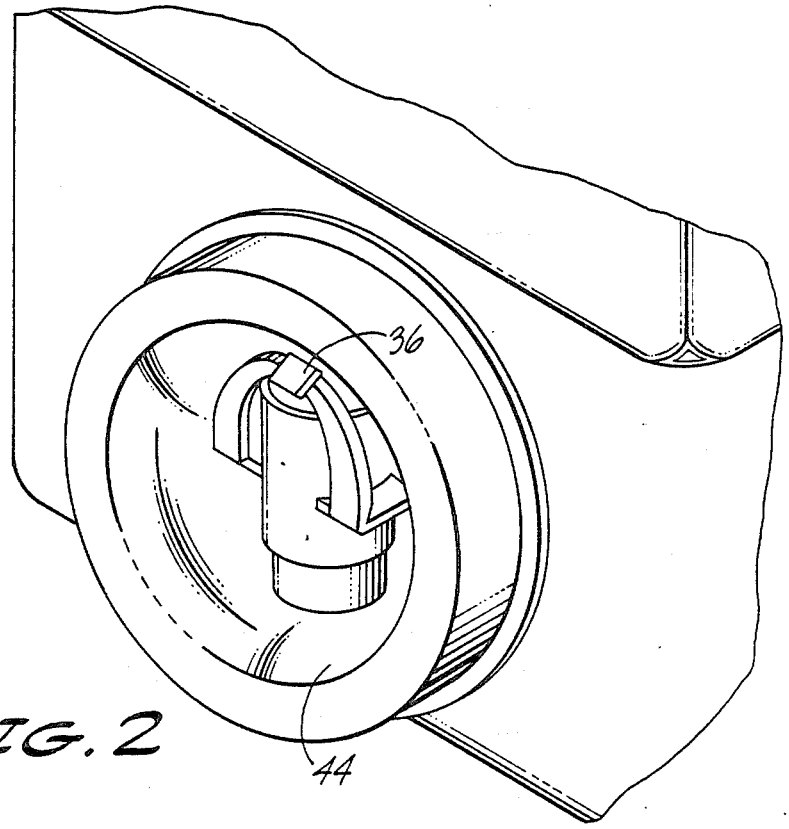
FIG. 2 is a perspective view of the dispensing apparatus shown in FIG. 1 in its collapsed or "nested" position with its pull-out ring tucked under a locking tab.

FIG. 2 shows the dispensing apparatus in its collapsed or nested position. In this position the flexible membrane cone 16 is inverted through the opening in the attachment means 12 so that substantially no part of the apparatus protrudes beyond the plane of the attachment means 12. The tapered flexible member 16 folds in upon itself to allow the dispensing valve 18 to collapse toward the container 14. Cavity 44 (see FIG. 2) defined in attachment means 12 preferably is of sufficient size to receive the dispensing valve 18 and flexible member 16 in nesting relationship (FIG. 2). In the nested position the pull-out ring 34 is folded along the length of the dispensing valve 18 and held in place by locking tab 36. As can be seen in FIG. 4, locking tab 36 is preferably integral with flexible member 16 and protrudes outwardly (and desirably upwardly) therefrom at a location which will cause the tab 36 to engage the ring 34 when the dispensing apparatus 10 is collapsed or nested (see FIG. 2).

Figure 3:
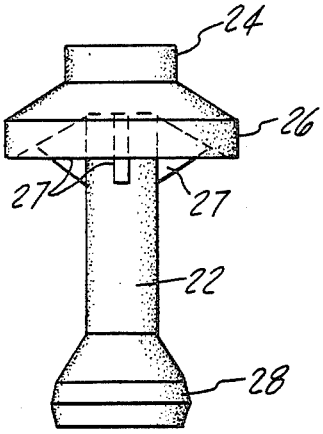
FIG. 3 is a side view of a valve stem of the dispensing valve in accordance with the preferred embodiment thereof.

Valve stem 22 is shown in greater detail in FIG. 3 desirably as a single molded article, preferably of a flexible, durable material not vulnerable to physical or chemical attack by the fluid to be dispensed. It should be appreciated that many such materials might be advantageously employed for the prupose. For example, in an experimental model of the apparatus 10, satisfactory performance was obtained from a valve stem 22 which was made of a synthetic rubber which is marketed under the Shell Chemical trademark "Crayton". The flexible disc-shaped diaphragm 26 flares downwardly and is constructed and arranged in cooperation with valve body 20 to be biased in its at-rest, unactuated position (see FIG. 4) to bring the plug 28 into contact with corresponding valve seat 38 so that the valve 18 is naturally biased to a closed position. Diaphragm 26 is desirably fitted on its underside (i.e., concave side) with radially-disposed ribs 27 which serve to increase the springing force exerted by diaphragm 26 upon plug 28 and valve seat 38 when valve 18 is in the closed position.

Figure 5:
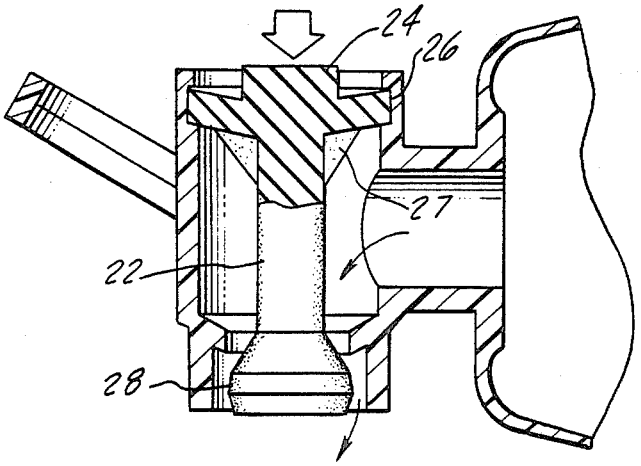
FIG. 5 is a side elevation, partially in section, of the dispensing valve shown in FIG. 4 but with the valve stem in its open or dispensing position.

FIG. 5 illustrates the cooperation of the valve stem 22 with the valve body 20 when the valve 18 is operated by longitudinal pressure, e.g., manual, on the button 24, to flex the disc 26 and disengage the plug 28 from valve seat 38 to open the valve. While the valve 18 is thus held open, fluid from the container 14 is allowed to flow through tubular duct 40 which connects the interior of the flexible membrance cone 16 to the valve body 20, entering the valve through an opening 42. When pressure is released from the button 24, the diaphragm 26 springs back to its resting configuration to retract plug 28 and hold plug 28 firmly against the valve seat 38 to close the valve.

Many modifications and alterations of the foregoing preferred embodiment will be suggested and made apparent to those skilled in the art which do not depart from the spririt and scope of our invention as defined by the appended claims.

What is claimed is:

1. An apparatus for dispensing fluid from a container having a wall comprising:

a selectively operable dispensing valve in fluid communication with the container which includes a valve body having a central chamber extending longitudinally therethrough from a first end thereof to a substantially opposite end thereof, for receiving a valve stem, an annular internal flange formed in the wall of said central chamber near the first end thereof, a valve seat formed in the wall of said central chamber near the second end thereof, a duct for introducing fluids into said central chamber, which duct communicates with said central chamber through an opening in the side wall of the valve body which lies between the annular internal flange and the valve seat, a valve stem extending longitudinally through said central chamber, which stem includes a central shaft on which is formed, as an integral part thereof, a flexible disc which extends radially therefrom and sealingly engages said annular internal flange, said central shaft having at its second end a bevelled plug sealingly engageable with said valve seat, said valve being iased to a first closed-valve position wherein the bevelled plug is drawn sealingly against the valve seat by rearwardly-directed springing force transmitted from the flexible disc through the central shaft to the bevelled plug, said valve being selectively movable between the first closed-valve position and a second open-valve position wherein the flexible disc is flexed, and the stem displaced, longitudinally toward the valve seat, creating a gap between the valve seat and the bevelled plug through which fluid can be dispensed;

means defining a cavity of sufficient size to allow said dispensing valve to nest inside the cavity;

extendable-nestable means supporting said dispensing valve to said cavity-defining means constructed and arranged selectively to allow said dispensing valve to move between a nested position in said cavity and to an extended position outwardly from said cavity;

means for mounting said dispensing apparatus to a wall of the container; and means for locking the dispensing valve in its nested position comprising a pull tab secured to the dispensing valve and a locking tab extending from the extendable-nestable means.

2. An apparatus for dispensing fluid from a container having a wall comprising:

a selectively operable dispensing valve in fluid communication with the container which includes a valve body having a central chamber extending longitudinally therethrough from a first end thereof to a substantially opposite second end thereof, for receiving a valve stem, an annular internal flange formed in the wall of said central chamber near the first end thereof, a valve seat formed in the wall of said central chamber near the second end thereof, a duct for introducing fluids into said central chamber, which duct communicates with said central chamber through an opening in the side wall of the valve body which lies between the annular internal flange and the valve seat, a valve stem extending longitudinally through said central chamber, which stem includes a central shaft on which is formed, as an integral part thereof, a flexible disc which extends radially therefrom, which is biased to curve concavely toward the valve seat, and which has on its concavely-curved side at least one radially-disposed rib, which disc sealingly engages said annular internal flange said central shaft having at its second end a bevelled plug sealingly engageable with said valve seat, said valve being biased to a first closed-valve position wherein the bevelled plug is drawn sealingly against the valve seat by rearwardly-directed springing force transmitted from the flexible disc through the central shaft to the bevelled plug, said valve being selectively movable between the first closed-valve position and a second open-valve position wherein the flexible disc is flexed, and the stem displaced, longitudiinally toward the valve seat, creating a gap between the valve seat and the bevelled plug through which fluid can be dispensed;

means defining a cavity of sufficient size to allow said dispensing valve to nest inside the cavity;

extendable-nestable means supporting said dispensing valve to said cavity-defining means constructed and arranged selectively to allow said dispensing valve to move between a nested position in said cavity and to an extended position outwardly from said cavity;

means for mounting said dispensing apparatus to a wall of the container; and means for locking the dispensing valve in its nested position comprising a pulling tab secured to the dispensing valve and a locking tab extending from the extendable-nestable means.

3. An apparatus for dispensing fluid from a container which comprises a selectively-operable dispensing valve in fluid communication with the container, means defining a cavity of sufficient size to allow said dispensing valve to nest inside the cavity, means for mounting the dispensing apparatus to a wall of the container, a flexible-extendable member interconnecting said mounting means and said valve, and a pulling tab for selectively moving the dispensing valve between a nested position in said cavity and an extended position outwardly from said cavity, said pulling tab having a first end attached to the valve and a second end which is movable between a first position for pulling the valve and a second position for locking the valve, and locking means extending from the flexible-extendable member constructed and arranged to engage the pulling tab in its locking position when the valve is nested in the cavity.

4. The apparatus of claim 3 which further comprises holding means which are affixed to the body of said dispensing valve, which extend bilaterally therefrom, and which are adapted for use as a finger hold when the valve is manually operated; and wherein said flexible-extendable member is a tapered hollow tube secured at its wider end to said mounting means and at its narrower end to said dispensing valve, and wherein said locking means includes a tab formed upon the surface of the tapered hollow tube at a location which is proximate to an end of the valve body when the valve is in its nested position, and wherein said pulling tab when in its first position extends outwardly from the valve and when in its second position lies against the valve body, along the length thereof, the second end of said pulling tab extending beyond the end of the valve body which is proximate to the locking tab, the locking and pulling tabs being so configured, dimensioned and arranged with respect to each other that when the valve is in its nested position and the pulling tab in its second position, the second end of the pulling tab may be tucked underneath the locking tab to achieve locking engagement.

* * * * *

UNITED STATES PATENT AND TRADEMARK OFFICE

CERTIFICATE OF CORRECTION

PATENT NO. : 4,693,400

DATED : September 15, 1987

INVENTOR(S) : Frahm, Carl E., et al.

It is certified that error appears in the above-identified patent and that said Letters Patent are hereby corrected as shown below:

Column 1, line 12 - Please change "deviec" to "device".

Column 3, line 50 - Please change "prupose" to "purpose".

Column 4, line 23 - After the word "opposite", please add "second".

Column 4, line 41 - Please change "iased" to "biased".

Column 5, line 36 - Please change "longitudiinally" to "longitudinally".

Signed and Sealed this

Fifteenth Day of March, 1988

*Attest:*

*Attesting Officer*

DONALD J. QUIGG

*Commissioner of Patents and Trademarks*